US005292121A

United States Patent [19]

Heddon

[11] Patent Number: 5,292,121

[45] Date of Patent: Mar. 8, 1994

[54] PNEUMATIC BOWLING BALL RETURN METHOD AND APPARATUS

[75] Inventor: Will Heddon, Lake Wales, Fla.

[73] Assignee: Heddon Bowling Corporation, Dundee, Fla.

[21] Appl. No.: 940,238

[22] Filed: Sep. 3, 1992

[51] Int. Cl.[5] ..... A63D 5/02

[52] U.S. Cl. ..... 473/111; 273/182 R; 273/179 D

[58] Field of Search ..... 273/179 D, 47, 48, 49, 273/122 R, 122 A, 125 R, 125 A, 129 AP; 29/DIG. 78

[56] References Cited

U.S. PATENT DOCUMENTS

| | | | |
|---|---|---|---|
| 1,885,662 | 11/1932 | Whitehorn . | |
| 1,931,841 | 10/1933 | Evans | 273/179 D |
| 1,987,000 | 1/1935 | Cahill . | |
| 2,247,787 | 7/1941 | Schmidt . | |
| 3,260,527 | 7/1966 | Younce | 273/179 D |
| 3,599,980 | 8/1971 | Harmond | 273/179 D |
| 3,711,038 | 1/1973 | Van Otteren . | |
| 4,272,078 | 6/1981 | Vinette | 273/179 D X |
| 4,984,939 | 1/1991 | Foreman et al. . | |

*Primary Examiner*—Vincent Millin
*Assistant Examiner*—William M. Pierce
*Attorney, Agent, or Firm*—Allen, Dyer, Doppelt, Franjola & Milbrath

[57] ABSTRACT

A bowling ball is returned from the pit area of the bowling alley to the ball storage rack in the approach area of the alley through a pneumatic transfer apparatus and method. The bowling ball is delivered from the pit area to an elongated tube via an inclined track and sucked into the elongated tube where it is accelerated through the tube located under the alley toward the approach area of the alley. As the bowling ball reaches the approach area it is diverted from its travel in the elongated tube and forced into a lift tube which delivers the bowling ball to a ball storage rack in the approach area located above the alley floor. The bowling ball return apparatus makes use of pneumatic techniques and controls the speed of the bowling ball by regulating the fan rotation of an inline motor and fan assembly. The pneumatic bowling ball return apparatus is modified for use with conventional power lift devices used to carry the bowling ball from the subway below the alley floor to the ball storage rack.

21 Claims, 6 Drawing Sheets

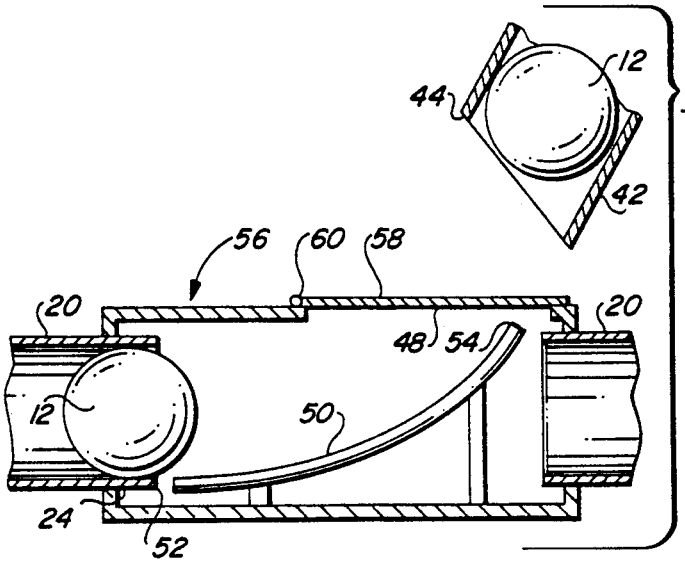
FIG. 5
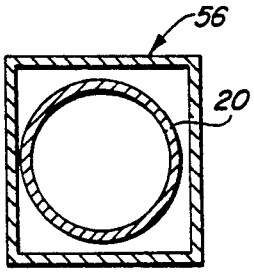
FIG. 6
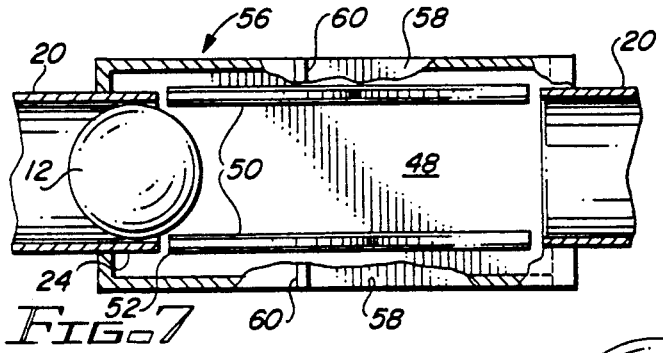
FIG. 7
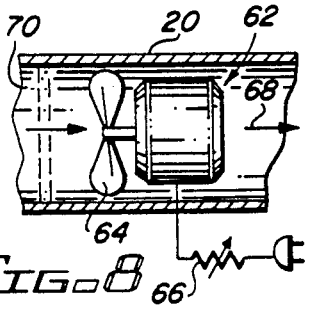
FIG. 8
FIG. 3
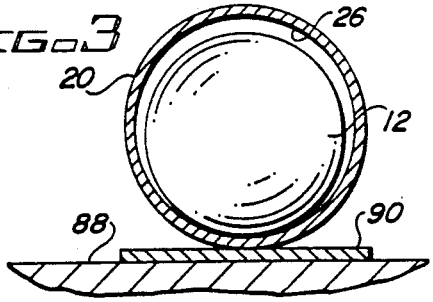
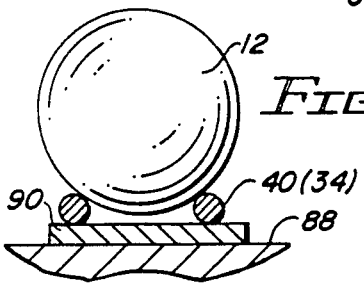
FIG. 4
FIG. 9
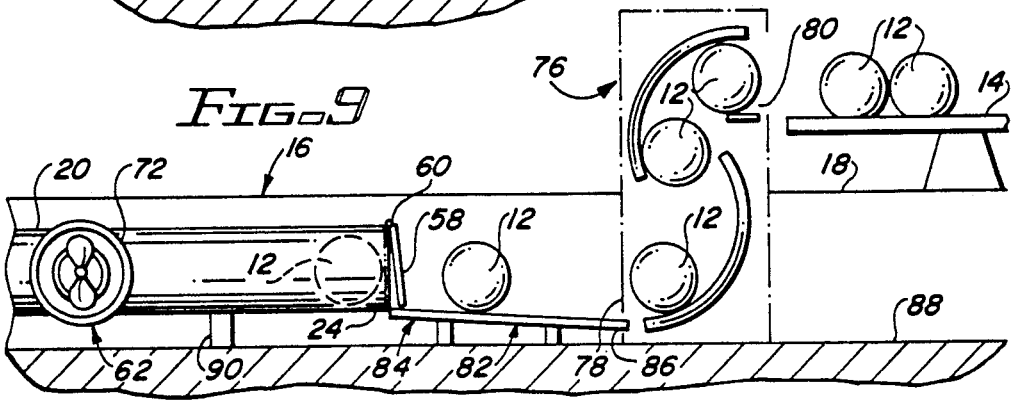

PNEUMATIC BOWLING BALL RETURN METHOD AND APPARATUS

BACKGROUND OF THE INVENTION

Field of the Invention

The invention relates to a bowling ball return apparatus and method, and specifically to the return of a bowling ball from the pit area of a bowling alley to the ball storage rack located in the approach area of the bowling alley.

Background Art

The ancient game of bowling has seen much in the evolution of the methods and devices used to return the a bowling ball to the bowler after the bowling ball has been used to knock down bowling pins. Many of the methods used manually by human pin setters were carried over to mechanical devices. One such device includes a mechanical arm that lifts the bowling ball to a track elevated above the bowling alley in the pit area. The bowling ball builds up momentum and therefore speed by rolling down the inclined track to a level track running along side and usually below the alley to the approach or player's area. The elevation of the inclined track needed to be high enough to provide initial speed to the bowling ball so that it could reach the ball storage racks located above the alley at the approach end of the alley. To assist the bowling ball in rolling up the inclined plane to the ball storage rack, wheel and belt devices were devised to impart sufficient added momentum to the ball to allow it to roll up the inclined plane to the storage rack.

U.S. Pat. No. 1,987,000 (Bowling Alley) issued Jan. 8, 1935 to G. F. Cahill discloses as one of the objectives of the invention to accelerate the return of the bowling ball from the pin or pit end of the alley to the approach or player's end of the alley and in particular to enable the bowling ball to climb to the elevated player's end of the alley in which the player's end is elevated above the pit end of the alley. Various devices are disclosed for use in accelerating the bowling ball using wheels and belts in contact with the bowling ball.

U.S. Pat. No. 2,247,787 (Suction Lifter) issued on Jul. 1, 1941 to G. J. Schmidt discloses a transfer mechanism comprising a suction head provided with a vacuum and motor controlled assembly that can lift and relocate a bowling ball from one position to another. It is anticipated that this invention could be used to relocate a bowling ball from a pit area to an elevated track for its initial acceleration from the pit area to the approach area. In addition, this invention could be configured to relocate the bowling ball from a location on the track below the alley to a ball storage rack located above the alley.

In typical bowling ball return systems of today, the bowling ball is accelerated from the pit area by the various methods discussed. The bowling ball is accelerated only to the point where it can reach a location below the approach area. The bowling ball is then feed into a power lift assembly which carries the bowling ball to the ball storage rack. The lift assembly is housed in a ball lift hood to conceal it from the player's view. There are inherent problems associated with these typical return devices that include the need to stop operations because balls of varying weights have traveled at various speeds and stack together so as to cause a jamming along the return and at the power lift.

The use of track to transport the bowling ball from the pit area to the approach area of a bowling alley has seen extensive use. The use of track to transport a sphere in general has been disclosed in various arts as seen in U.S. Pat. No. 1,885,662 (Electric Railway System) issued on Nov. 1, 1932 to H. K. Whitehorn. The Whitehorn invention discloses a sphere being transported over a two rail system as well as a tube.

The present invention also relates to the use of pneumatics to propel the bowling ball along an elongated tube. Pneumatic tube transmission systems have been employed to transport containers. U.S. Pat. No. 4,984,939 (Pneumatic Tube Transmission System With Slow-Down Blower) issued on Jan. 15, 1991 to M. J. Foreman and H. R. Greene and U.S. Pat. No. 3,711,038 (Pneumatic Tube System) issued on Jan. 16, 1973 to W. M. Van Otteren disclose such pneumatic systems.

SUMMARY OF INVENTION

The present invention contemplates an apparatus for returning a bowling ball from a pit end of a bowling alley to an approach end of the bowling alley. Means are provided to transport the bowling ball from the pit area to an entrance end of an elongated tube. The elongated tube has the entrance end near to the pit area and an exit end near the approach area. The elongated tube has a bore sized to receive the bowling ball. Air flows through the elongated tube such that a vacuum is formed at the entrance end. The bowling ball is received at the entrance end and accelerated through the elongated tube toward the exit end located near the approach end of the alley.

In one embodiment of the invention, the exit end of the elongated tube is such that the bowling ball is delivered to a power lift. The power lift then raises the bowling ball up to a ball storage rack located above the bowling alley in the approach area. For this first embodiment, a track runs from immediately adjacent to the pit area where it receives the bowling ball and delivers the bowling ball to the entrance end of the elongated tube. This track is inclined downward from the pit area to the elongated tube. The pit area is elevated with respect to the elongated tube. The elongated tube will run along the floor between two lanes as in a typical return system but can be installed under ground.

The pit area and approach area of the alley are typically elevated above the floor. The ball storage rack is elevated above the approach area.

A means for forming an air flow from the entrance end of the elongated tube to the exit end is accomplished by inserting a conduit into the elongated tube near the exit end of the elongated tube. A fan is placed in the conduit and rotated such to cause the air to flow from the entrance end of the elongated tube toward the exit end. The air flow is controlled by controlling a fan motor through the selection of a desired horse power rating for the motor, by selecting a desired pitch for a fan blade or a combination or these methods. By controlling the air flow, the acceleration and ultimately the speed of the bowling ball is controlled so that the bowling ball can roll to the exit end of the elongated tube. The exit end of the elongated tube is located adjacent to the power lift that carries the bowling ball up to the storage rack located above the approach area.

Unlike bowling balls being accelerated from the pit area to the lift along a track, bowling balls accelerated through the tube maintain an air cushion between the balls and do not stack up against each other during their transport through the elongated tube.

In a second embodiment, the elongated tube works in conjunction with a lift tube to deliver the bowling ball directly to the ball storage rack. In this embodiment, the need for the power lift is eliminated. The elongated tube has means for diverting the bowling ball to the lift tube. A track is placed in the elongated tube so as to divert the bowling ball as it rolls toward the exit end of the elongated tube. The diverted bowling ball passes through an opening in the top wall of the elongated tube or end of the elongated tube or top wall or end of a vacuum box into the entrance of the lift tube. The speed of the bowling ball is such to propel the ball up the lift tube and out the exit of the lift tube which is located so as to deposit the bowling ball into the ball storage rack.

In the second embodiment, a fan motor assembly is affixed to the exit end or side wall of the elongated tube. An air flow is selected by varying the speed of the fan motor. Other air flow controls such as varying horse power, motor rotational speed, pitch and fan size can also be used.

BRIEF DESCRIPTION OF DRAWINGS

A preferred embodiment of the invention as well as a second embodiment are described by way of example with reference to the accompanying drawings in which:

FIG. 3 is a partial cross-sectional end view of an elongated tube illustrating the relationship of the bowling ball to the elongated tube bore;

FIG. 4 is a partial cross-sectional end view of track rails carrying the bowling ball;

FIG. 5 is a cross-sectional side view of a vacuum box containing a lift track receiving the bowling ball and delivering the bowling ball through an opening in the vacuum box having a flap and hinge arrangement;

FIG. 6 is an end view of the vacuum box receiving the elongated tube;

FIG. 7 is a cross-sectional top view of the vacuum box;

FIG. 8 is a cross-sectional side view of a motor and fan assembly affixed to the exit end of the elongated tube;

FIG. 9 is a partial cross-sectional elevation view of the approach end of the bowling alley showing a second embodiment of the invention using a power lift arrangement to deliver the bowling ball to a ball storage rack;

DETAILED DESCRIPTION OF PREFERRED EMBODIMENT

Figure 1:
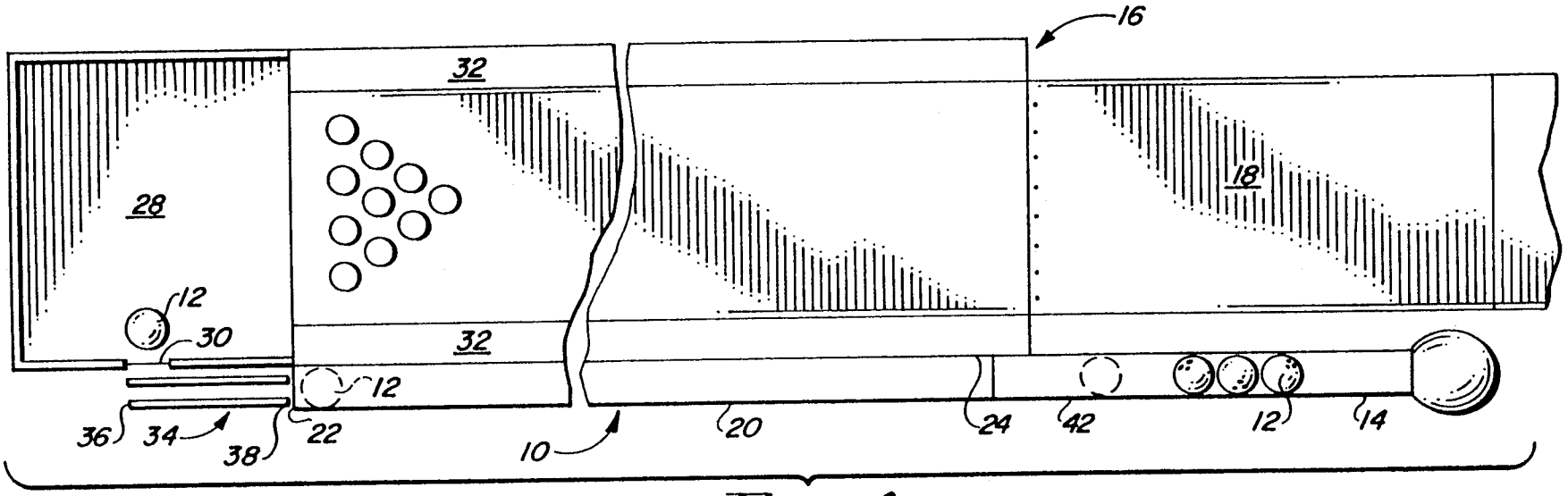
FIG. 1 is a partial top view of a bowling alley showing the position of the ball return apparatus relative to the pit area and approach area of the bowling alley.
Figure 2:
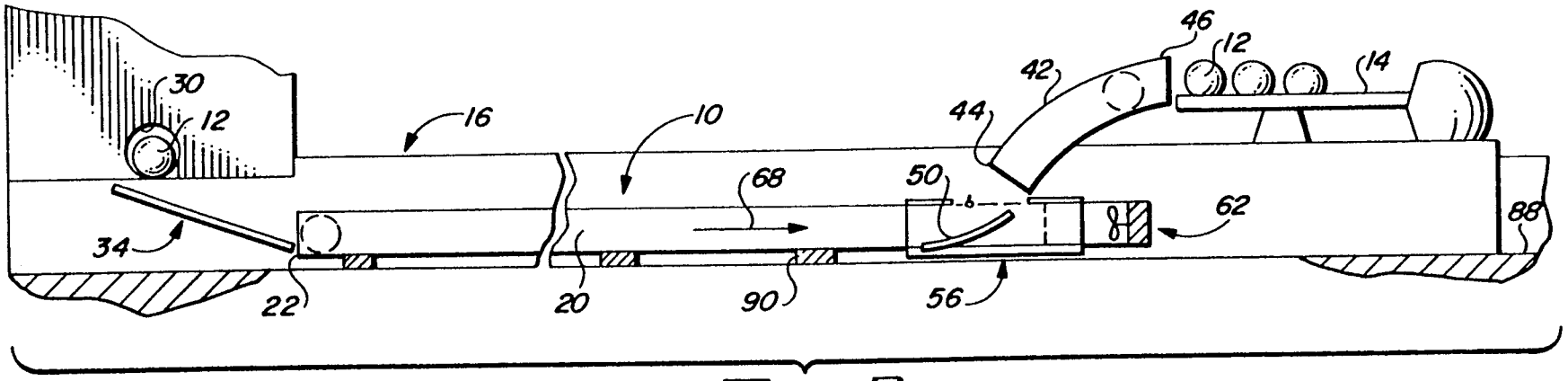
FIG. 2 is a partial cross-sectional elevation view of the bowling alley in which the preferred embodiment of the invention is illustrated

The preferred embodiment of the invention, a bowling ball return apparatus 10, is disclosed in FIG. 1 and FIG. 2. As installed, the apparatus 10 receives a bowling ball 12 from the pit area 28 of a bowling alley 16 through a ball pit exit door 30 onto a track 34. The track first end 36 is adjacent to the ball pit exit door 30 and elevated above the track second end 38 which is adjacent to the entrance end 22 of an elongated tube 20. Track 34 having parallel rails 40 has long been used to transport spherical objects and especially bowling balls 12 as shown in FIG. 4. The elongated tube has the entrance end 22 in the vicinity of the pit area 28 and an exit end in the vicinity of an approach area 18 of the bowling alley. The bowling ball 12 is received at the track first end 36 and rolls down the inclined track 34 to the entrance end 22 of the elongated tube 20.

A motor and fan assembly 62 as shown in FIG. 8 is affixed inline or coaxially with the elongated tube 20 at the exit end 24 of the elongated tube 20. The fan 64 is rotated so as to create an air flow 68 from the entrance end 22 to the exit end 24 of the elongated tube 20. This air flow 68 forms a vacuum at the entrance end 22 of the elongated tube 20 where the bowling ball 12 is sucked into the elongated tube 20. The elongated tube 20 has a bore 26 shaped for closely receiving the bowling ball 12 as shown in FIG. 3. A regulated power supply 66 controls the speed of the motor and fan assembly 62 which in turn controls the air flow 68. The bowling ball 12 is accelerated through the elongated tube 20 toward the exit end 24 of the elongated tube 20. To protect the fan 64 from unwanted debris that may be sucked through the elongated tube 20, a screen 70 as shown in FIG. 8 is affixed between the fan 64 and the lift track 50.

A vacuum box 56 shown in FIG. 5, FIG. 6 and FIG. 7 is positioned at the exit end 24 of the elongated tube 20 and receives the elongated tube 20. The vacuum box 56 contains a lift track 50 with a first end 52 affixed so as to receive the bowling ball 12 as it leaves the exit end 24 of the elongated tube 20. The lift track 50 diverts the bowling ball 12 through an opening 48 in the top of the vacuum box 56 and toward an entrance end 44 of a lift tube 42. The momentum and thus speed of the ball is such that it rolls along the lift track 50 and through the lift tube 42 to the exit end 46 of the lift tube 42 where it is deposited into a ball storage rack 14 located above the approach area 18 floor elevation.

The level of the elongated tube 20 and relative positions of elongated tube and dependent elements is maintained using shims 90 located between the floor 88 and the elongated tube 20. To provide for a minimum loss of air flow 68 and a smooth ball speed control, a flap 58 is placed over the opening 48 in the vacuum box 56. The flap 58 is affixed along one end 60 to permit movement and allow the bowling ball 12 to pass from the lift track 50 to the lift tube entrance end 44. It is anticipated that the lift track 50 can be installed within the elongated tube 20 without the use of the vacuum box 56 by incorporating an opening 48 in the top of the elongated tube 20 at the position where the bowling ball 12 is to be ejected from the elongated tube 20 into the lift tube entrance end 44. A flap 58 affixed at one end 60 similar to that discussed above would be employed.

Figure 10:
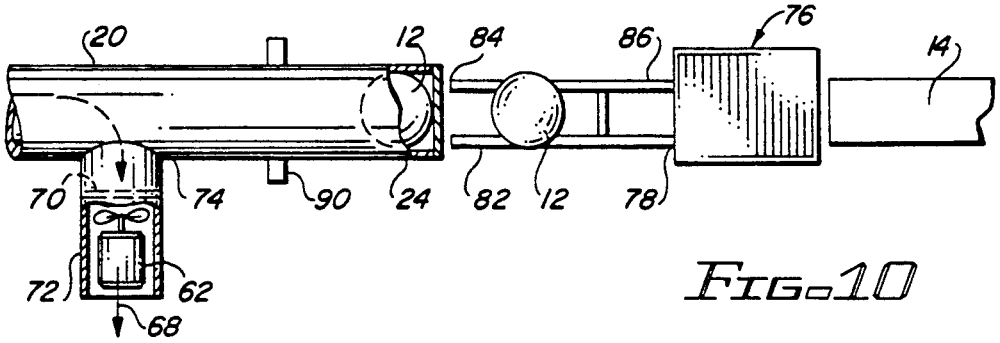
FIG. 10 is a partial cross-sectional top view of the second embodiment of the invention showing fan motor setup, track to the power lift and exit end of the elongated tube.

A second embodiment is anticipated when a partial replacement of a bowling ball return system is made in an existing bowling alley facility or when a bowling alley plans to incorporate existing power lift 76 equipment to carry the bowling ball 12 from a subway below the approach area 18 to the ball storage rack 14. FIG. 9 and FIG. 10 show a partial view of this second embodiment.

In this second embodiment for the invention, the exit end 24 of the elongated tube 20 terminates near an entrance end 78 of the power lift 76 placed on the floor 88. A power lift entrance track 82 is placed between the exit end on the elongated tube 20 and the power lift entrance end 78 such that the bowling ball 12 is received at the exit end 24 of the elongated tube 20 by a first end 84 of the power lift entrance track 82 and accelerated toward the exit end 80 of the power lift entrance track 82 affixed so as to allow the bowing ball 12 to be accepted by the power lift 76 at its entrance end 78. Refer to FIG. 9.

The bowling ball 12 is transported from the pit area 28 toward the exit end 24 of the elongated tube 20 as it is in the preferred embodiment. See FIG. 1 and FIG. 2. However, in the second embodiment, the air flow 68 used to accelerate the bowling ball 12 is created with a motor and fan assembly 62 located near the exit end 24 but between the exit end 24 and the entrance end 22 of the elongated tube 20. A conduit 72 is affixed to a side wall 74 of the elongated tube 20 in the proximity of but not at the exit end 24 of the elongated tube 20. The motor and fan assembly 62 is affixed inline to the conduit 72 with the rotation of the fan 64 such that the air flow 68 accelerates the bowling ball 12 from the entrance end 22 of the elongated tube 20 toward the exit end 24 and out the conduit 72.

The exit end 24 of the elongated tube 20 is closed using a flap 58. The flap 58 is sized larger than the elongated tube bore 26 and affixed at the top of the elongated tube 20. The bowling ball 12 rolls out the exit end 24 of the elongated tube 20 by pushing against the outwardly hinged flap 58. The direction of the air flow 68 out the side wall 74 of the elongated tube 20 and through the conduit 72 causes a partial vacuum at the hinged flap 58. This partial vacuum acts as a cushion for the rolling bowling ball 12 and provides the needed braking for the bowling ball 12 before it ejects from the elongated tube 20. The rotation of the motor and fan assembly 62 is controlled from a variable power supply 66 as in the preferred embodiment. In the case of the second embodiment, the distance between the exit end 24 of the elongated tube 20 and the conduit 72 location in the side wall 74 is also used in establishing the speed of the bowling ball 12 and in particular the speed with which it leaves the exit end 24 of the elongated tube 20.

The invention discloses the apparatus used to deliver a bowling ball 12 from its useless place in a bowling alley 16 pit area 28 to the ball storage rack 14 where a bowler can retrieve it for the next attempt at his sport, bowling.

Figure 11:
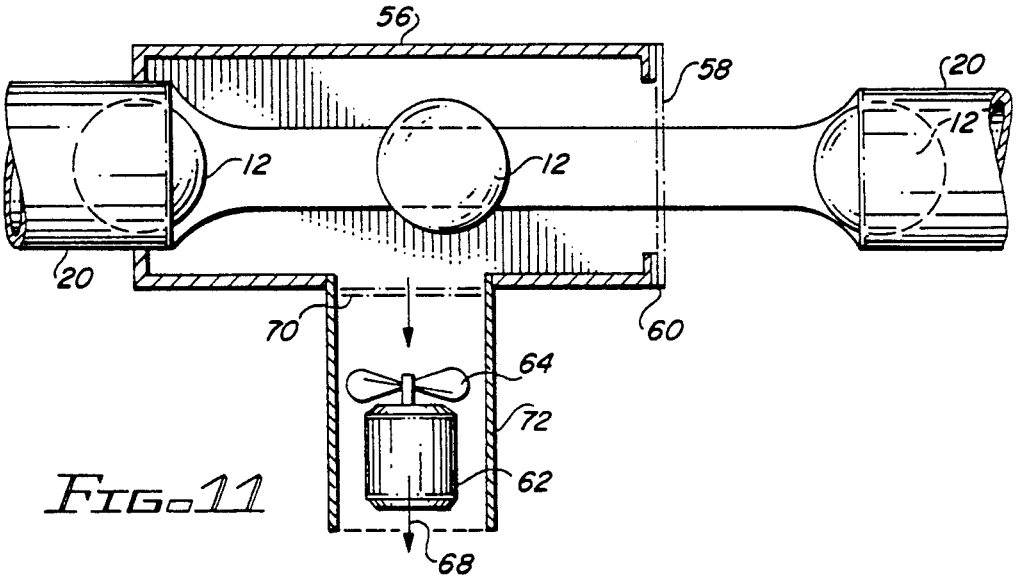
FIG. 11 is a partial cross-sectional top view of another vacuum box embodiment showing the use of a partial section of the elongated tube used to replace the track and the fan motor assembly affixed to the vacuum box.
Figure 12:
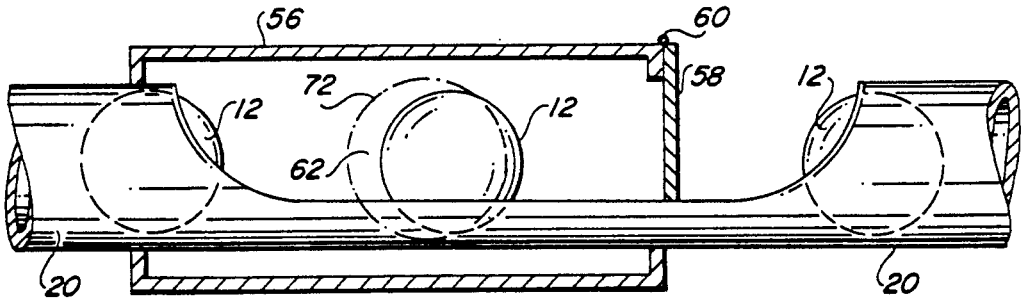
FIG. 12 is a partial cross-sectional side view of the vacuum box showing the cutaway elongated tube used in place of track and the use of a flap at an exit to the vacuum box.
Figure 13:
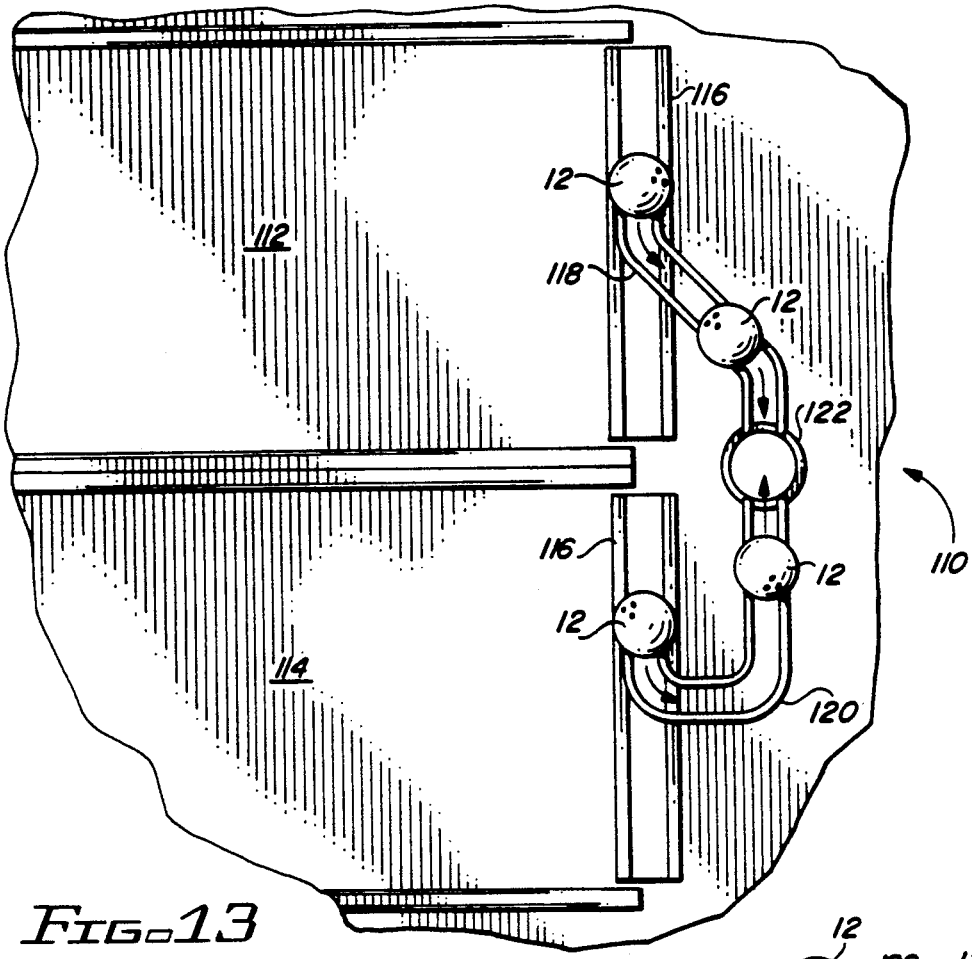
Figure 14:
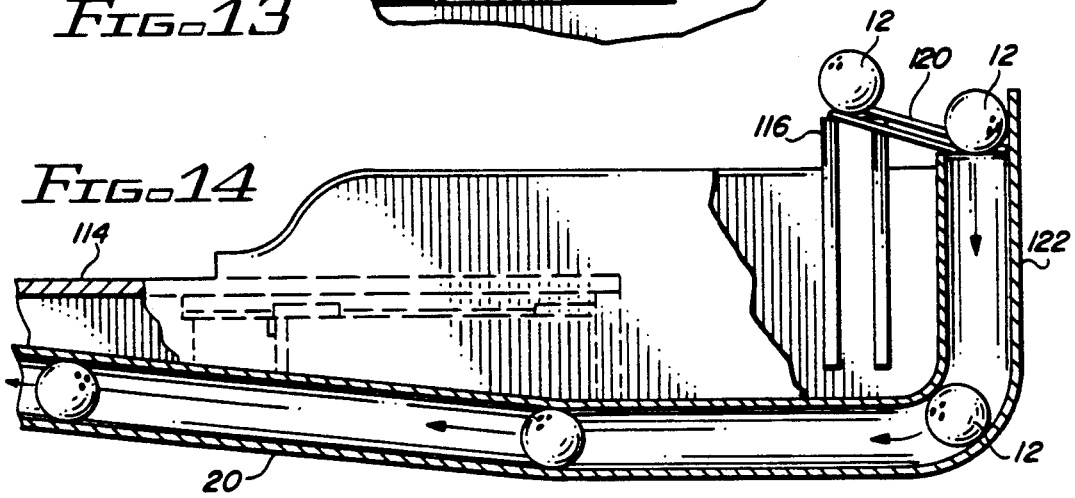
Figure 21:
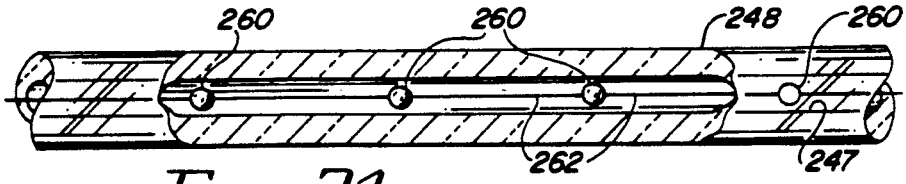
Figures 15, 16, 17:
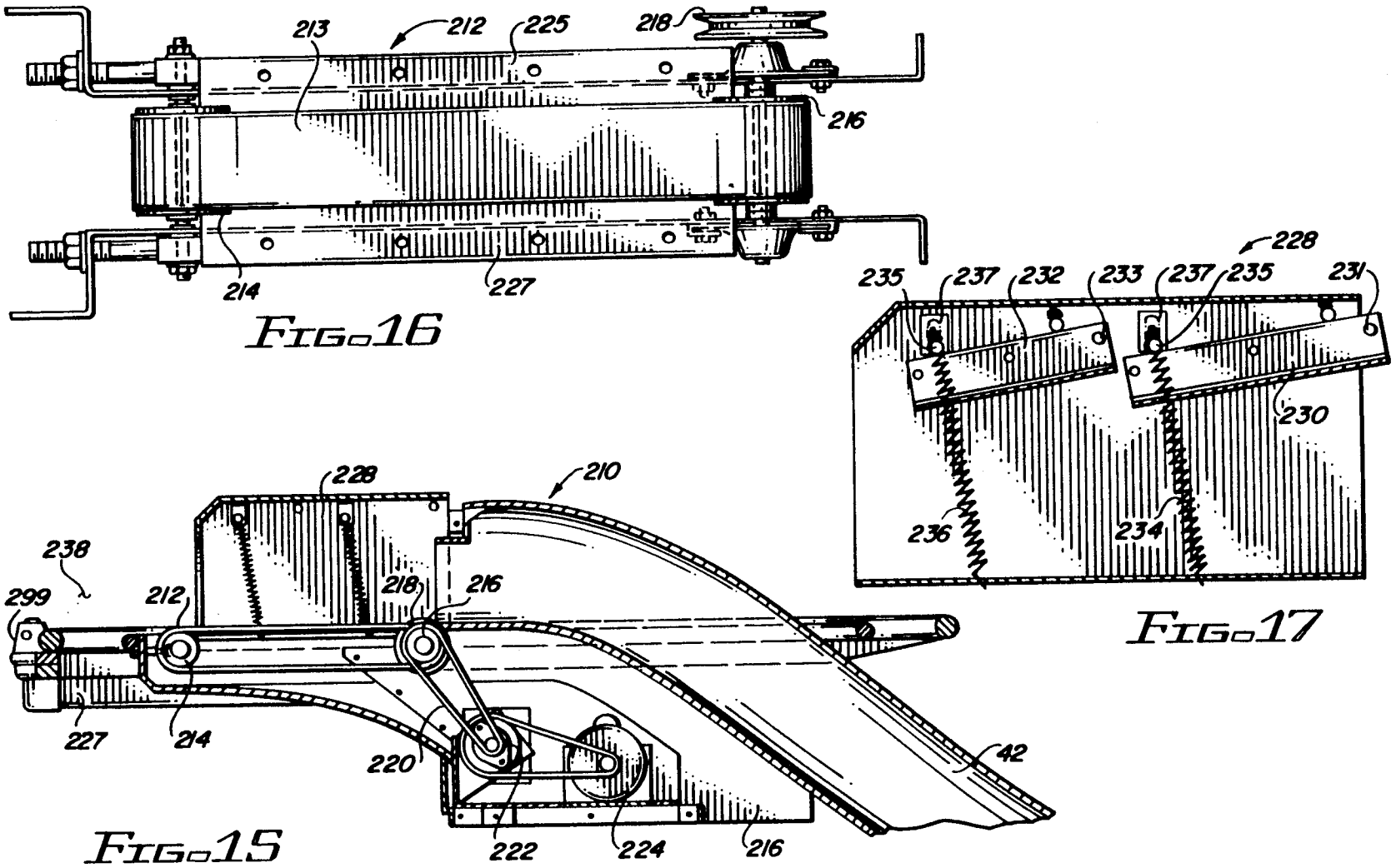
Figure 18:
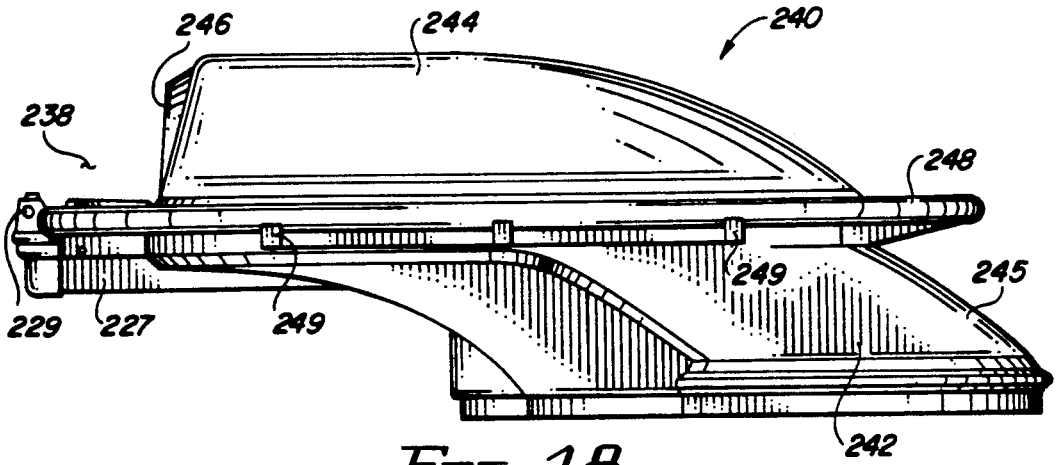
Figure 19:
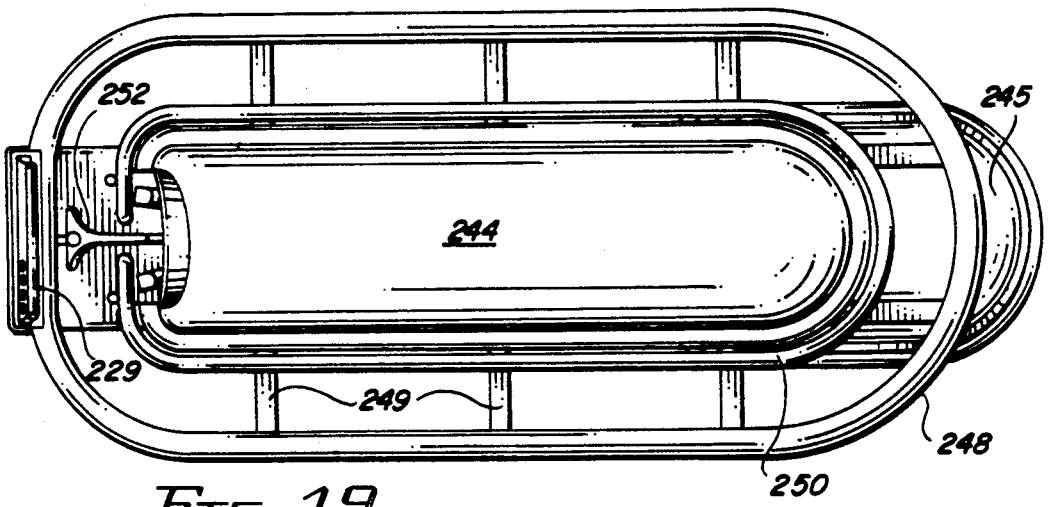
Figure 20:
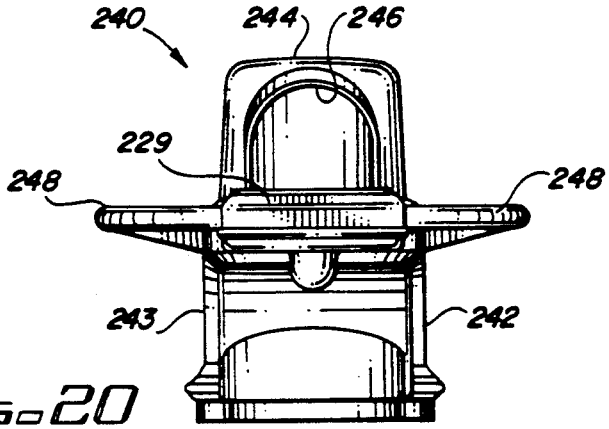

Two embodiments have been disclosed for the bowling ball return. Variations within each embodiment are anticipated. One such variation includes using the elongated tube 20, the vacuum box 56 and the motor and fan assembly 62 in a combined configuration. FIG. 11 illustrates this configuration. The elongated tube 20 having a full bore 26 penetrates an end wall of the vacuum box 56. Inside the vacuum box 56, the elongated tube 20 is partially cut along the tube wall in such a way to keep the bottom of the tube wall in place and remove the sides and top of the tube wall. The bowling ball 12 will roll uninterrupted from the full bore to the cut tube through the vacuum box and leave out an exit end of the vacuum box. The motor and fan assembly 62 is affixed to the side wall of the vacuum box rather than the exit end of the vacuum as described earlier. Air flow 68 is established at a desired level based on the location of this vacuum box configuration with respect to the power lift 76 or the lift tube 42 in the embodiments disclosed. A flap 58 is affixed to the exit end of the vacuum box 60 for efficient air flow control. The partially cut elongated tube is extended outside the vacuum box . Once outside the vacuum box 56, the elongated tube 20 is returned to a full bore condition to allow the bowling ball 12 to be directed as desired to a lift tube 42 or to a power lift 76 as described. FIG. 11 and FIG. 12 illustrate the use of this vacuum box embodiment.

It is anticipated that one skilled in the art of bowling ball return systems can devise other embodiments and combinations of the elements disclosed.

What is claimed is:

1. An apparatus for returning bowling balls from a pit end of a bowling alley to an approach end of the bowling alley, the apparatus comprising:

an elongated tube having a bore extending therethrough;

the tube having an entrance end and an exit end;

the bore being shaped for closely receiving bowling balls at the entrance end and sequentially passing the bowling balls therethrough to the exit end;

a track having a first end and a second end, the track having a set of parallel rails, the rails positioned so as to sequentially receive and pass the bowling balls, the track first end positioned for sequentially receiving the bowling balls at a trough located adjacent to and in alignment with a pit end of an alley, the track second end positioned below the first end and immediately adjacent to the entrance end of the tube;

means for delivering the bowling balls to a position immediately adjacent to and in alignment with the entrance end of the tube; and means for sequentially sucking the bowling balls into the entrance end of the tube and for accelerating the bowling balls out the exit end.

2. The apparatus recited in claim 1 wherein the means for sucking the bowling balls into the entrance end of the tube and for accelerating the bowling balls toward the exit end comprises:

a source of air flow;

a conduit extending from the source of air flow and terminating in the bore of the tube; and a direction of air flow towards the exit end of the tube forming a partial vacuum at the entrance end of the tube so as to suck the bowling ball from the entrance end to the exit end of the tube.

3. The apparatus recited in claim 2 wherein the source of air flow comprises:

an electric motor and fan blade assembly;

a power source for the motor and fan blade assembly comprising a regulated power supply;

means for affixing the electric motor and fan blade assembly in the conduit; and means for adjusting the air flow by adjustment of the regulated power supply.

4. An apparatus for delivering bowling balls from a pit area of a bowling alley to an approach area storage rack, the apparatus comprising:

an elongated tube having a bore extending therethrough, the tube having an entrance end and an exit end, the bore being shaped for closely receiving bowling balls at the entrance end and sequentially passing the bowling balls therethrough to the exit end;

a lift tube having an entrance end and an exit end, the lift tube having a bore equal to the bore of the elongated tube, the lift tube entrance end proximate to the elongated tube exit end, the lift tube entrance end positioned for sequentially receiving the bowling balls exiting the elongated tube;

means for delivering the bowling balls from a pit area to a position immediately adjacent to and in alignment with the entrance end of the tube; and means for forming a partial vacuum at the entrance end of the tube and sequentially sucking the bowling balls into the entrance end of the tube and for accelerating the balls toward the exit end the partial vacuum means positioned to the tube exit end;

a lift track having a first end and a second end, the first end of the lift track affixed to the elongated tube bore at a lower surface of the bore, the second end of the lift track affixed tot he first end of the lift tube at a lower surface of the bore of the lift tube, the track positioned for sequentially receiving the bowling balls at the track first end and diverting the bowling balls to the track second, the track second end passing the balls form the tube exit end to the entrance end of the lift tube, the lift tube exit end affixed above an alley surface for sequentially delivering the bowling balls to an approach area ball storage rack; and means for controlling the speed of the balls while traveling from the entrance end of the elongated tube to the exit end of the lift tube for placement into the ball storage rack.

5. The apparatus recited in claim 4 wherein the delivering means comprises:

a track having a first end and a second end further comprising:

a set of parallel rails; and the rails positioned so as to sequentially receive and pass the bowling balls;

the first end located so as to sequentially receive the bowling balls at a ball pit exit door located adjacent to and in alignment with a pit end of an alley; and the second end positioned below the first end and immediately adjacent to the entrance end of the tube.

6. The apparatus recited in claim 4 wherein the partial vacuum forming means comprises:

a vacuum box affixed to the exit end of the elongated tube for providing a source of air flow in the elongated tube; and a direction of air flow towards the exit end of the tube forming a partial vacuum at the entrance end of the tube so as to sequentially suck the bowling balls from the entrance end toward the exit end of the tube.

7. The apparatus recited in claim 6 wherein the source of air flow comprises:

an electric motor and fan blade assembly;

a power source for the motor and fan blade assembly comprising a regulated power supply; and means for affixing the electric motor and fan blade assembly in the vacuum box.

8. The apparatus recited in claim 4 further comprising:

a top wall of the elongated tube having an opening for receiving the lift track in combination with bowling balls rolling on the track;

a flap covering the opening for maintaining a smooth air flow through the elongated tube; and the flap hinged to the elongated tube wall, the flap biased against the tube opening from tube exit end partial forces.

9. The apparatus recited in claim 4 wherein the means for controlling the speed of the ball comprises a variable speed motor controller affixed to the electric motor and fan blade assembly used as the source of air flow in the tube.

10. The apparatus recited in claim 4 wherein the elongated tube is affixed below the pit area and below the storage rack between a set of lanes sharing the ball storage rack at the approach end of the alley.

11. An apparatus for returning bowling balls from a pit area of a bowling alley to a ball storage rack at the approach area of the bowling alley, the apparatus comprising:

an elongated tube having:

an entrance end and an exit end;

a bore extending therethrough; and the bore being shaped for closely receiving bowling balls;

a track at the entrance end of the tube having:

a pair of rails parallel and separated to sequentially receive the bowling balls;

a first end and a second end;

the first end affixed at a pit area and immediately adjacent to and in alignment with a trough located at a pit end of a bowling alley;

the second end affixed at the entrance end of the tube and positioned immediately adjacent to and in alignment with the entrance end of the tube; and the first end in a raised position when compared to the second end;

a source of air flow comprising:

a vacuum box affixed to the exit end of the elongated tube;

a motor and fan assembly, the motor and fan assembly affixed to the vacuum box, the fan having a fan rotating for providing a direction of air flow from the entrance end of the tube to the exit end; and a regulated power source cooperating with the motor for controlling the speed of the motor;

the elongated tube having an opening on the top side of the tube wall approximate to the exit end of the tube;

a lift tube having:

a first end and a second exit end;

a bore equal to the tube bore and passing therethrough;

the first end affixed proximate to the elongated tube opening; and the second exit end affixed above the alley floor positioned for sequentially depositing the bowling balls into a ball storage rack;

a lift track passing through the tube wall opening having:

a set of parallel rails positioned so as to sequentially receive the balls;

a first end and a second end;

the first end affixed to the bottom of the bore of the elongated tube approximate to the tube opening; and the second end affixed to the first end of the lift tube;

the tube opening such to receive the ball and lift track in combination; and a flap covering the tube opening the flap hinged to the tube wall.

12. A method of delivering bowling balls from a pit area of a bowling alley to an approach end of the bowling alley comprising the steps of:

providing an elongated tube having an entrance end and an exit end, the tube having a bore for closely receiving bowling balls;

placing the tube entrance end proximate a bowling alley pit area;

placing the tube exit end proximate a bowling alley approach area;

providing a track having a first end and a second end;

placing the first end adjacent to the pit area in a position for sequentially receiving the bowling balls;

placing the track second end adjacent the tube entrance end;

delivering the bowling balls from the pit area to the track first end; and positioning the track for sequentially delivering the balls from the first end to the second end into a position for being received at the tube entrance end.

sequentially delivering the bowling balls from the pit area to the entrance end of the elongated tube;

injecting an air flow through the elongated tube such that a partial vacuum is created at the entrance end;

sequentially placing the bowling balls at the entrance end of the elongated tube so that the bowling balls are sequentially sucked from the entrance end to the elongated tube exit end, the exit end proximate to the approach area; and regulating the air flow for controlling the speed with which the bowling balls travel from the elongated tube entrance end to the exit end of the elongated tube.

13. A method of returning bowling balls from a pit area of a bowling alley to a ball storage rack located at an approach area of the alley, the method comprising the steps of:

providing an elongated tube having an entrance end and an exit end, the tube having a bore for closely receiving bowling balls;

placing the tube entrance end proximate and below a bowling alley pit area;

placing the tube exit end proximate a bowling alley approach area;

providing a track having a first end and a second end;

placing the track first end proximate the pit area in a position for sequentially receiving the bowling balls;

placing the track second end adjacent the tube entrance end;

positioning the track for sequentially delivering the balls from the first end to the second end into a position for receiving bowling balls at the tube entrance end;

sequentially delivering the bowling balls from the pit area at an elevation above the elongated tube along the track to the entrance end of the elongated tube;

injecting an air flow through the elongated tube such that a partial vacuum is created at the tube entrance end;

receiving the bowling balls to and in alignment with the entrance end of the elongated tube so that the bowling balls are sequentially sucked from the entrance end toward the exit end of the elongated tube in proximity to the approach end of the alley;

ejecting the bowling ball from the elongated tube exit end;

placing the exit end of the elongated tube proximate a ball storage rack located above the alley in the approach area of the alley;

sequentially delivering the bowling balls from the tube exit end to the ball storage rack; and regulating the air flow for controlling the speed with which the bowling balls travel from the entrance end of the elongated tube to the exit end of the tube.

14. The method recited in claim 13 further comprising the steps of:

providing a lift tube having an entrance end and an exit end, the lift tube having a bore dimensioned for receiving a bowling ball;

placing the entrance end of the lift tube proximate a top wall of the elongated tube exit end;

placing the lift tube exit end for sequentially delivering the bowling balls to the ball storage rack;

providing a lift track having a first end and a second end;

affixing the first end of the lift track to the elongated tube bore at a lower surface of the bore;

affixing the second end of the lift track proximate to the entrance end of the lift tube, for cooperating with the lift tube entrance end to sequentially receive the bowling balls and delivering the bowling balls to the lift tube exit end for placing the balls into the ball storage rack;

providing the top wall of the elongated tube with an opening so as to receive the lift track and a bowling ball rolling on the track;

providing a flap;

covering the opening with the flap for maintaining a smooth air flow through the elongated tube;

affixing one end of the flap to the elongated tube wall;

biasing the flap biased against the tube using the exit end partial vacuum forces, the bowling balls directed from the track through the opening sufficient to overcome the biasing force and sequentially pass through the opening; and sequentially delivering the bowling balls through the opening into the lift tube entrance end and therethrough to the lift tube exit end; and depositing the bowling balls into the ball storage rack.

15. An apparatus for returning bowling balls from a bowling alley pit area to an approach area, the apparatus comprising:

an elongated tube having a bore extending therethrough, the tube having an entrance end positioned proximate to a pit area and an exit end positioned proximate to an approach area, the tube bore being shaped for closely receiving bowling balls at the entrance end and sequentially passing the bowling balls therethrough to the exit end;

means for sequentially delivering the bowling balls from the pit area to the tube entrance end;

means for generating air flow for causing partial vacuums at the tube ends, the partial vacuum at the tube entrance end for sequentially sucking bowling balls at the entrance end and accelerating the balls toward the tube exit end through a substantial portion of the tube, the partial vacuum at the tube exit end causing an opposite air flow in a remaining portion of the tube proximate the tube exit, the opposing air flow decelerating the bowling balls passing through the remaining portion to the exit end; and means for sequentially delivering the bowling balls from the tube exit end to the approach area.

16. The apparatus recited in claim 15 wherein the means for delivering the bowling balls from the pit area to the tube entrance end comprises a track having a set of parallel rails dimensioned to sequentially receive the bowling balls, the track having a first end and a second end, the first end positioned to sequentially receive the bowling balls at a trough located at the pit area, the second end positioned immediately adjacent to the entrance end of the tube.

17. The apparatus recited in claim 15 wherein the air flow generating means comprises:

a side wall of the elongated tube having an opening for permitting air flow therethrough, the opening positioned proximate the tube exit end a distance from the exit end, the distance allowing the opposing air flow sufficient for decelerating the bowling balls through the tube exit end remaining portion consistent with the approach delivering means;

a conduit having a proximal end and a distal end, the proximal end affixed for communicating with the tube side wall opening;

a fan and motor assembly affixed to the conduit, the assembly operating such that air flows from the conduit proximal end to the conduit distal end, the air flow providing the partial vacuums at the elongated tube ends; and means for varying air flow, the varying air flow means providing varying bowling ball speeds for travel from the tube entrance end toward the exit end and opposing air flow from the tube exit end.

18. The apparatus recited in claim 15 wherein the means for sequentially delivering the bowling balls from the tube exit end to the approach area comprises:

a lift track having a set of parallel rails spaced to sequentially transport the bowling balls, the lift track having a first end and a second end, the lift track first end affixed to the tube bore lower surface, the lift track first end positioned to sequentially receive the bowling balls, the lift track second end affixed proximate to a top wall of the tube, the top wall having an opening, the opening sized for receiving the track transporting a ball therethrough; and a lift tube having an entrance end and an exit end, the lift tube having a bore sized for sequentially receiving the bowling balls, the lift tube entrance end positioned to sequentially receive the bowling balls, the bowling balls being sucked from the elongated tube entrance end and accelerated toward the elongated tube exit end being diverted by the lift track through the elongated tube top wall opening and into the lift tube entrance end, the lift tube exit end positioned for sequentially depositing the bowling balls onto a ball storage rack, the ball storage rack positioned at the approach area.

19. The apparatus as recited in claim 18 further comprising a flap across the top wall opening, the flap hinged for permitting the bowling balls to pass through the opening, the flap held in position by the exit end partial vacuum.

20. The apparatus as recited in claim 15, wherein the means for delivering the bowling balls from the tube exit end to the approach area comprises:

an exit track having a set of parallel rails spaced to sequentially transport the bowling balls, the exit track having a first end and a second end, the first end proximate to the tube exit end for cooperating with the tube exit end to sequentially receive the bowling balls exiting the tube; and a power lift having an entrance end and exit end, the entrance end communicating with the exit track second end to sequentially receive the bowling balls from the exit track, the power lift exit end positioned for delivering the bowling balls to a ball storage rack at the approach area.

21. The apparatus as recited in claim 20 further comprising a flap covering the tube exit end, the flap biased against the tube exit end by forces from the exit end partial vacuum, the flap rotatably hinged to the tube for moving from a biased position to an open position as the bowling balls sequentially roll through the tube exit end.

* * * * *